US007178459B2

(12) United States Patent
Stefani

(10) Patent No.: US 7,178,459 B2
(45) Date of Patent: Feb. 20, 2007

(54) APPARATUS FOR DISTRIBUTING POWDERS ON A SUPPORT IN A PREDETERMINED PATTERN

(75) Inventor: Franco Stefani, Sassuolo (IT)

(73) Assignee: System S.p.A., Fiorano Modenese (IT)

( * ) Notice: Subject to any disclaimer, the term of this patent is extended or adjusted under 35 U.S.C. 154(b) by 99 days.

(21) Appl. No.: 10/529,763

(22) PCT Filed: Sep. 30, 2002

(86) PCT No.: PCT/IT02/00621

§ 371 (c)(1),
(2), (4) Date: Mar. 30, 2005

(87) PCT Pub. No.: WO2004/028767

PCT Pub. Date: Apr. 8, 2004

(65) Prior Publication Data

US 2006/0000373 A1 Jan. 5, 2006

(51) Int. Cl.
*B41L 13/00* (2006.01)

(52) U.S. Cl. ..... 101/120; 101/123

(58) Field of Classification Search ..... 101/114, 101/115, 116, 118, 119, 120, 121, 122, 123, 101/124, 126, 127, 129
See application file for complete search history.

(56) References Cited

U.S. PATENT DOCUMENTS 2,019,375 A * 10/1935 Wheelwright ..... 101/115
3,487,775 A * 1/1970 Chaney et al. ..... 101/114
3,772,054 A * 11/1973 Anselrode ..... 427/282
4,729,305 A * 3/1988 Spencer ..... 101/35
4,753,163 A 6/1988 Blaak
6,145,434 A * 11/2000 Tanaka et al. ..... 101/129

FOREIGN PATENT DOCUMENTS

EP 1 063 068 12/2000
EP 1 162 047 2/2001

* cited by examiner

*Primary Examiner*—Ren Yan
(74) *Attorney, Agent, or Firm*—Young & Thompson

(57) ABSTRACT

An apparatus for distributing powders on a support in a predetermined pattern, includes: a belt conveyor (2) for transporting the support (3); a head for applying the powders (1), located above the conveyor (2), which head (1) includes a ring-wound closed continuous belt (4) exhibiting a plurality of perforations arranged according to a predetermined pattern, the perforations being of a size which enables passage of predetermined quantities of powders; a mechanism for controlling a supply and delivery of powders through the perforations and for keeping the continuous belt (4) clean. The head also includes a mechanism for controlling a movement of the continuous belt (4) in synchrony with a movement of the conveyor (2).

8 Claims, 2 Drawing Sheets

APPARATUS FOR DISTRIBUTING POWDERS ON A SUPPORT IN A PREDETERMINED PATTERN

TECHNICAL FIELD

The invention relates to an apparatus for distributing powders on a support in a predetermined pattern.

BACKGROUND ART

Specifically, though not exclusively, the invention is usefully applied in the production of ceramic tiles or slabs.

In particular the invention is usefully applied in a dry-decorating line, i.e. in which powders are laid on supports (tiles or slabs) which have already been formed by a pressing operation, or on supports which are still soft before being subjected to pressing.

Dry decoration using powders is known in flat silk-screening machines, similar to those used with liquid glazes, or in rotary machines which use cylindrical silk screens, also similar to those used with liquid glazes.

These applications exhibits several limitations. In particular, rotary machines using cylindrical silk screens are structurally limited because they do not enable operations beyond certain size limitations (corresponding to the size of the cylindrical screen) inasmuch as the diameter of the screen cannot be increased beyond certain limits.

This problem is overcome, for example, by the invention described in EP publication EP 1162047, which describes an apparatus for distributing powders on a support according to a predetermined design, which comprises: a belt conveyor for transporting the supports; a head for applying the powders located above the belt conveyor, the head comprising a continuous ring-wound belt exhibiting a plurality of perforations arranged in a predetermined design and of such a size as to allow through only predetermined quantities of powders. The ring-wound holed belt is entirely under tension and is kept clean by the continuous action of pneumatic means using aspiration mouths located in a drum on which the belt is draggingly wound. Special distributor organs convey the powders on the internal side of the perforated belt in order to effect the powder distribution on the supports through the perforations present on the belt.

An apparatus of this type exhibits the drawback of subjecting the belt to excessive and dangerous stresses. All of the distributor organs operate on the tensed belt. Also, the belt, while under tension, is forced to drag on the drum at which the cleaning operation is performed by pneumatic aspiration. All of this, plus the highly abrasive properties of the powders, can cause serious drawbacks with regard to the belt and can compromise normal operativity of the apparatus. A further limitation is constituted by the poor precision which the system offers during the guiding of the belt the critical zone where the distributor organs operate.

The present invention proposes to obviate the drawbacks and limitations in the prior art.

An advantage of the present invention is that it is structured so as not to impose any theoretical limitation on the length of the perforated belt.

A further advantage of the invention is that the quantity of powders passing through the perforations and depositing on the underlying supports can be batched in an extremely simple way.

A further advantage of the invention consists in allowing use of quite wide perforated belts so that powders can be distributed with no difficulty on wide ceramic supports.

These aims and more besides are achieved by the object of the invention as it is characterised by the accompanying claims.

DISCLOSURE OF INVENTION

Further characteristics and advantages of the invention will better emerge from the detailed description that follows, of a preferred but non-limiting embodiment illustrated purely by way of example in the accompanying figures of the drawings, in which.

Figure 1:
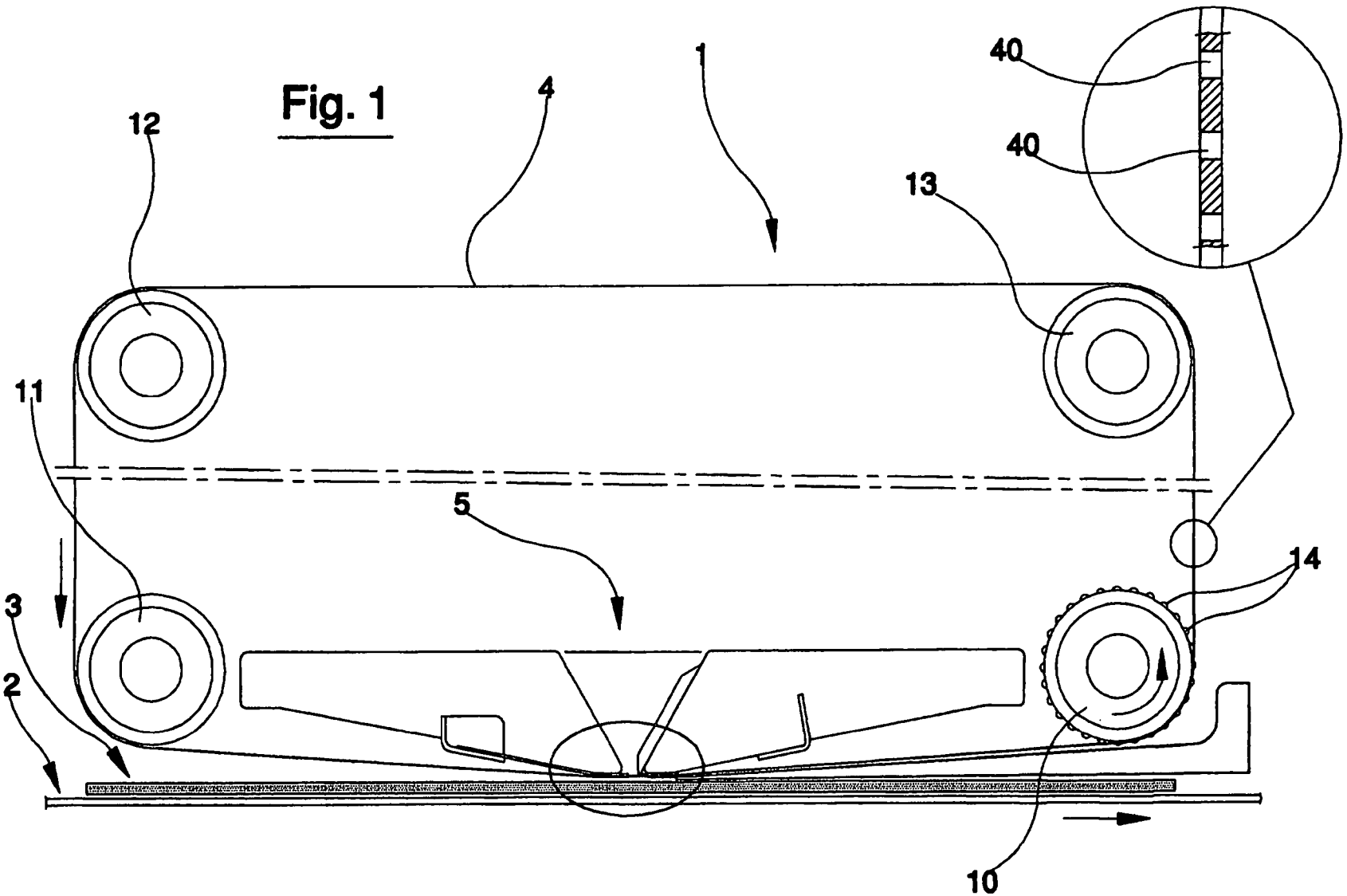
FIG. 1 is a schematic front view in vertical elevation.
Figure 2:
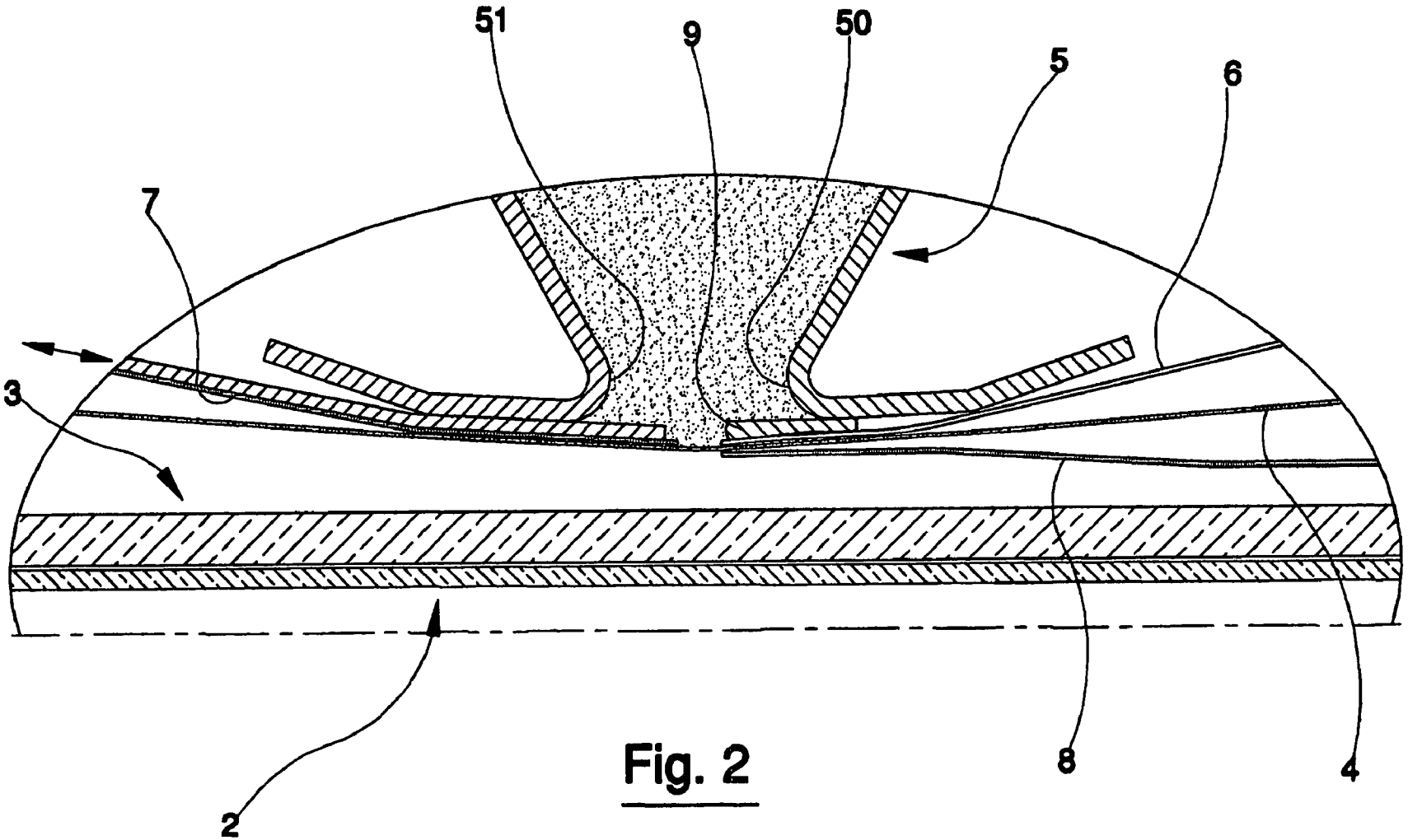
FIG. 2 is an enlarged-scale view of a detail of FIG. 1.

In the figures of the drawings, an apparatus for distributing powders in patterns on supports 3 is schematically illustrated. The apparatus essentially comprises: a belt conveyor 2 for transporting the support 3 and a head 1 for applying the powders on the support as it transits below the head 1, which head 1 is located above the conveyor 2 and comprises a ring-wound closed belt 4 exhibiting a plurality of perforations arranged according to a predetermined pattern, the holes having dimensions which allow passage there-through of predetermined quantities of powders.

The head 1 is provided with means for controlling the supply and/or delivery of powders through the perforations in the belt 4, as well as with means for keeping the belt 4 clean. Also provided are means for controlling the movement of the ring-wound belt 4 in synchrony with the motion of the conveyor 2 on which the supports 3 are transported. The supports 3 can be tiles, slabs, of large dimensions or can be layers of powders still soft and yet to be subjected to press-forming. The ring-wound belt 4 is of a non-cloth material, and is constant in thickness. Preferably the belt 4 is constituted by a film of Mylar or polycarbonate of the desired length. The belt is closed in a ring by a pressure heat-joint so that the uniformity of the belt thickness is not disturbed.

The belt can be quite thin and the patterned perforation therein can be made easily by laser incision.

Further, at its sides the belt 4 exhibits slots 40 used for moving the belt 4, which are arranged in longitudinal rows parallel to the longitudinal axis of the belt 4 itself.

During operation the ring-wound closed belt 4 is wound (partially) on a plurality of parallel-axis rollers (10, 11, 12 and 13) which are arranged transversally to the direction of advancement motion of the belt 4 and the conveyor 2.

The roller 10 of the plurality of parallel-axis rollers is a drive roller, which moves the belt 4. For this purpose it is provided with projecting radial pins 14 which fit into the slots 40.

The drive roller 10 is located, with reference to the advancement direction of the belt 4 and the conveyor 2, downstream of the means for controlling the supply and/or the delivery of the powders through the perforations and for keeping the belt 4 clean.

The means for controlling the supply and/or the delivery of the powders through the perforations and for keeping the belt 4 clean comprise a hopper 5 located at a short distance above the belt 4. The powders to be distributed are contained in the hopper 5.

The hopper 5 exhibits an outlet mouth which is located transversally with respect to the advancement direction of the belt 4 and the conveyor 2; the outlet mouth is delimited, perpendicularly to the advancement direction of the belt 4 and conveyor 2, by a front edge 50 and a back edge 51.

A fixed upper doctor 6 is predisposed to operate on the front edge 50 and is pressed against the upper face of the continuous conveyor 4 by an elastic element (a bearing) 9.

There is also a lower fixed doctor 8 which is pressed to operate against the lower face of the belt 4 in order to exert thereon an antagonistic action to the action exerted by the upper fixed doctor 6.

An adjustable doctor 7 is predisposed to operate on the front edge 50 and is pressed against the upper face of the belt 4 and arranged in an opposite direction and as an antagonist against the upper fixed doctor 6.

The position of the adjustable doctor 7 can be regulated as the adjustable doctor 7 is displaceable by translation in a perpendicular direction to the back edge 51 and to the front edge 50 so as to regulate, rather like a trap, the outlet mouth of the hopper 5.

At least the upper fixed doctor 6 and the lower fixed doctor 8 are elastically deformable. They are made of thin sheets, preferably of plastic, and their flexional deformability is exploited in order that they can squeeze the belt 4 between their relative free edges, thus scraping and cleaning the belt 4 on both sides.

The belt 4 is drawn by the drive roller 10 by means of pins which engage in the slots 40.

In this way only the part of belt 4 constituted by the tract comprised between the mouth of the hopper 5 and the drive roller 10 is subjected to tensioning. This enables a correct positioning of the belt 4 with respect to the underlying conveyor 2 and to the supports 3 being carried thereon; also, a minimal stress is placed on the belt 4.

Furthermore, the lower fixed doctor 8 has the important function of preventing powder residues remaining in the tensed part of belt 4 (comprised between the point where the belt 4 is stretched between the free ends of the two fixed doctors 6 and 8 and the drive roller 10) from falling onto the powders which have just been correctly distributed according to a predetermined pattern (by the perforations in the belt 4) on the underlying support 3.

The presence of the adjustable doctor 7 which can be regulated by translation in a perpendicular direction to the back edge 51 and the front edge 50 of the outlet mouth of the hopper 5, means that adjustment of the aperture of the mouth of the hopper 5 is very easily done. This means that the quantity of powders deposited by free fall on the underlying support is properly batched.

The invention claimed is:

1. An apparatus for distributing powders on a support in a predetermined pattern, comprising: a belt conveyor (2) for transporting the support (3); a head for applying the powders (1), located above the conveyor (2), which head (1) comprises a ring-wound closed continuous belt (4) exhibiting a plurality of perforations arranged according to a predetermined pattern, which perforations are of a size which enables passage of predetermined quantities of powders; means for controlling a supply and delivery of powders through the perforations and for keeping the continuous belt (4) clean; means for controlling a movement of the continuous belt (4) in synchrony with a movement of the conveyor (2), characterised in that said means for controlling a supply and delivery of powders through the perforations and for keeping the continuous belt (4) clean comprise: a hopper (5) located at a short distance above the continuous belt (4); the hopper (5) exhibiting an outlet mouth which is transversally arranged with respect to the advancement direction of the continuous belt (4) and the conveyor (2), and which is delimited, perpendicular to the advancement direction of the continuous belt (4) and the conveyor (2), by a front edge (50) and a back edge (51); a fixed upper doctor (6) which operates at the front edge (50) and which is pressed against an upper face of the continuous belt (4) by a elastic element (9); a fixed lower doctor (8) which is pressed against a lower face of the continuous belt (4) and exerts thereon an antagonistic action to an action exerted by the fixed upper doctor (6); an adjustable doctor (7) which operates at the back edge (51) and is pressed against the upper face of the continuous belt (4) and is arranged opposite to and antagonistically to the fixed upper doctor (6); the adjustable doctor (7) being adjustable by sliding in a perpendicular direction to the back edge (51) and the front edge (50) in order to regulate an aperture of the outlet mouth of the hopper (5).

2. The apparatus of claim 1, wherein the continuous belt (4) is not made of a textile material and does not present any unevenness in a thickness thereof.

3. The apparatus of claim 2, wherein the continuous belt (4) at sides thereof exhibits slots (40) for drawing, which slots (40) are arranged in longitudinal rows parallel to a longitudinal axis of the continuous belt (4).

4. The apparatus of claim 1, wherein the continuous belt (4) at sides thereof exhibits slots (40) for drawing, which slots (40) are arranged in longitudinal rows parallel to a longitudinal axis of the continuous belt (4).

5. The apparatus of claim 4, wherein the continuous belt (4) is partially wound on a plurality of rollers (10,11, 12,13) having parallel axes which are arranged transversally to an advancement direction of the continuous belt (4) and the conveyor (2).

6. The apparatus of claim 1, wherein the continuous belt (4) is partially wound on a plurality of rollers (10,11, 12,13) having parallel axes which are arranged transversally to an advancement direction of the continuous belt (4) and the conveyor (2).

7. The apparatus of claim 6, wherein a roller (10) of the plurality of rollers (10,11, 12,13) is a drive roller and draws the continuous belt (4) in motion, and is equipped with radial projecting pins (14) which engage in slots (40); the drive roller being located downstream, with reference to the advancement direction of the continuous belt (4) and the conveyor (2), of the means for controlling a supply and delivery of powders through the perforations and for keeping the continuous belt (4) clean.

8. The apparatus of claim 7, wherein at least the fixed upper doctor (6) and the fixed lower doctor (8) are elastically deformable.

* * * * *